US005799966A

United States Patent [19]

Haldemann

[11] Patent Number: 5,799,966

[45] Date of Patent: Sep. 1, 1998

[54] DEVICE FOR FASTENING A SHOE TO A SNOW BOARD

[75] Inventor: Gaston Haldemann, Burgenstock, Switzerland

[73] Assignee: Skis Rossignol S.A., Voiron, France

[21] Appl. No.: 765,929

[22] PCT Filed: Jun. 19, 1995

[86] PCT No.: PCT/IB95/00493

§ 371 Date: Jan. 16, 1997

§ 102(e) Date: Jan. 16, 1997

[87] PCT Pub. No.: WO96/03185

PCT Pub. Date: Feb. 8, 1996

[30] Foreign Application Priority Data

Jul. 21, 1994 [CH] Switzerland ..... 2308/94

[51] Int. Cl.[6] ..... A63C 9/08

[52] U.S. Cl. ..... 280/613; 280/624

[58] Field of Search ..... 280/19.2, 617, 280/613, 615, 629, 634; 294/105, 107

[56] References Cited

FOREIGN PATENT DOCUMENTS

| | | |
|---|---|---|
| 0 350 411 | 1/1990 | European Pat. Off. . |
| 2 618 688 | 2/1989 | France . |
| 94 13 356 | 12/1994 | Germany . |
| 682 133 | 7/1993 | Switzerland . |

*Primary Examiner*—Gary C. Hoge
*Assistant Examiner*—Clovia Hamilton
*Attorney, Agent, or Firm*—Young & Thompson

[57] ABSTRACT

The device for fastening safely a shoe onto a snow board according to the invention includes two lateral jaws (2) carried by arms (15) mounted pivotally at their free ends on a first journal (17) perpendicularly to the plane of the board and movable in a direction parallel to this plane by the action of a resilient member (4) between a closed operative position, in which these jaws cooperate with a profiled pattern of the sole of the shoe and an open position, in which the same is released. Each jaw (2) is connected mechanically to the resilient urging member (4) via a rocking member (6) mounted in such a manner that it exhibits two stable positions, corresponding respectively to the open and to the closed position of the jaws (2).

11 Claims, 3 Drawing Sheets

DEVICE FOR FASTENING A SHOE TO A SNOW BOARD

The present invention is concerned with a device for fastening a shoe to a snow board and, more particularly, a safety fastening device, i. e. one which is disengaged in the case of a fall, an impact or a torsion and which includes a system which is automatically engaged when stepping into it, as well as a snow board shoe designed for cooperating with this fastening device.

Presently, snow surfing on a snow board is generally practised without any safety fastening means, contrary to conventional mountain skiing where, for example, a front bracket and a back bracket are provided to lock the shoe to the ski. Safety fastening means for snow boards have already been disclosed, for example in document FR-A-2,618,688, which include, for example, on a support which is fastened to the board, a front stop and a heel piece, similar to the safety fastening means used in conventional mountain skis. Such devices suffer the same drawbacks as those designed for mountain skis in that their safety is inadequate in case of an impact along the axis stop—heel piece and because of the accurate adjusting needed, which depends on the length of the sole of the shoe to be fastened; furthermore, the presence of two mechanical devices, a front one and a back one, respectively, adds weight in an undesirable manner to the snow board.

Fastening devices for snow boards are also known which are of the so-called central type (or with lateral jaws), in particular such as those described in the patent CH 682,133. However, this central fastening necessitates that the user carries out an operation on the device for bringing the jaws from their open non operative position to their closed operative position, for example by operating manually a lever. However, this operation can be difficult to carry out for certain users or when the snow board is in a situation where it is partly covered with snow.

Accordingly, the purpose of the present invention is to provide a safety device for the fastening of a shoe onto a snow board which does not suffer the above described drawbacks of known fastening devices, and which makes it possible, in particular, to use the same fastening device for shoes of differing lengths and which further includes a system which is engaged automatically when stepping into it.

A second object of the invention is a shoe for a snow board designed for fastening on a snow board by means of a safety fastening device according to the invention.

The invention will be described in detail hereafter, with reference to the annexed drawing. This drawing illustrates schematically and by way of example a particular embodiment of the invention.

Figure 1:
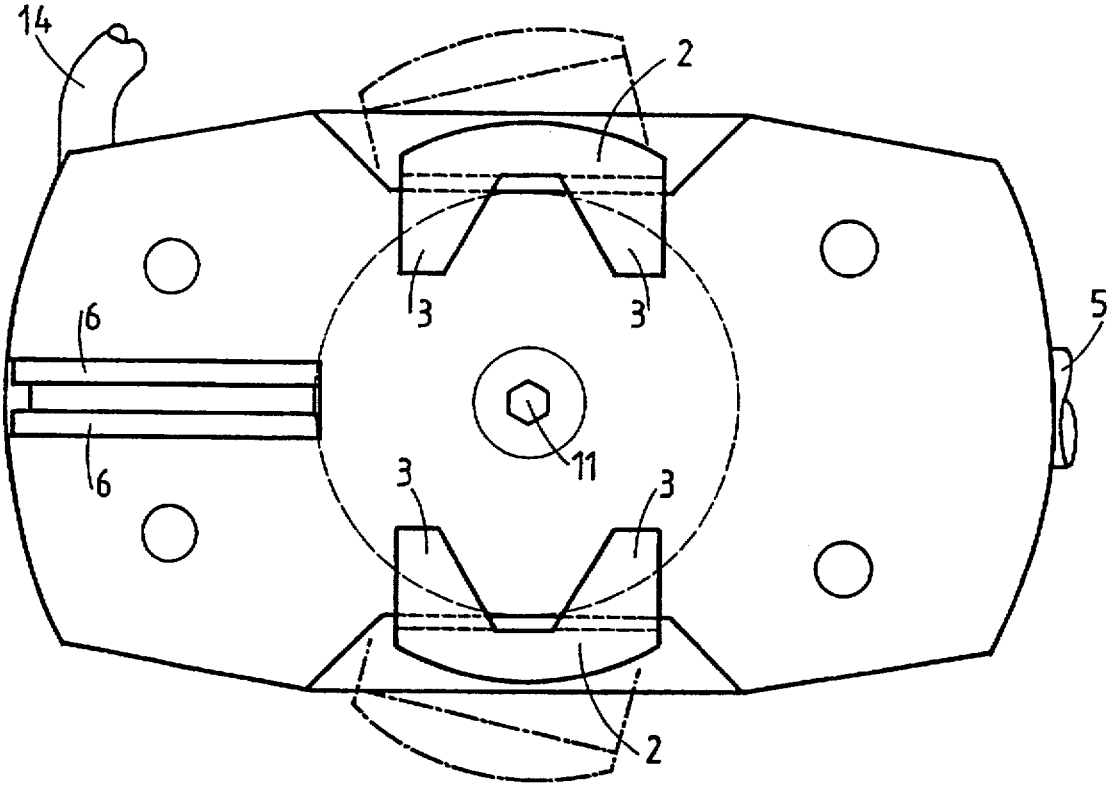
FIG. 1 is a plan view and FIG. 2 is a front view, both showing the sole portion of the fastened shoe.
Figure 2:
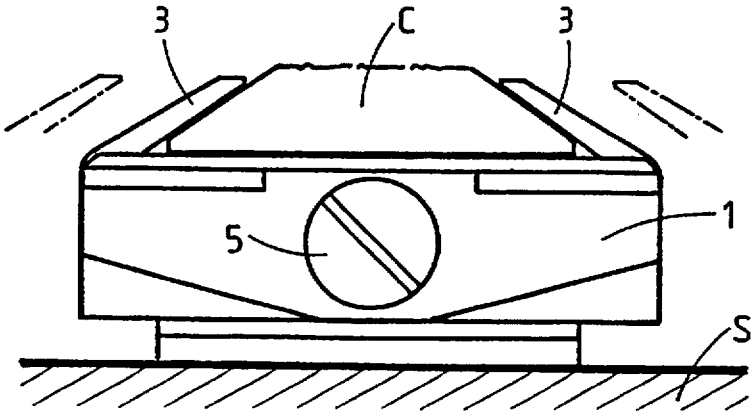
Figure 3:
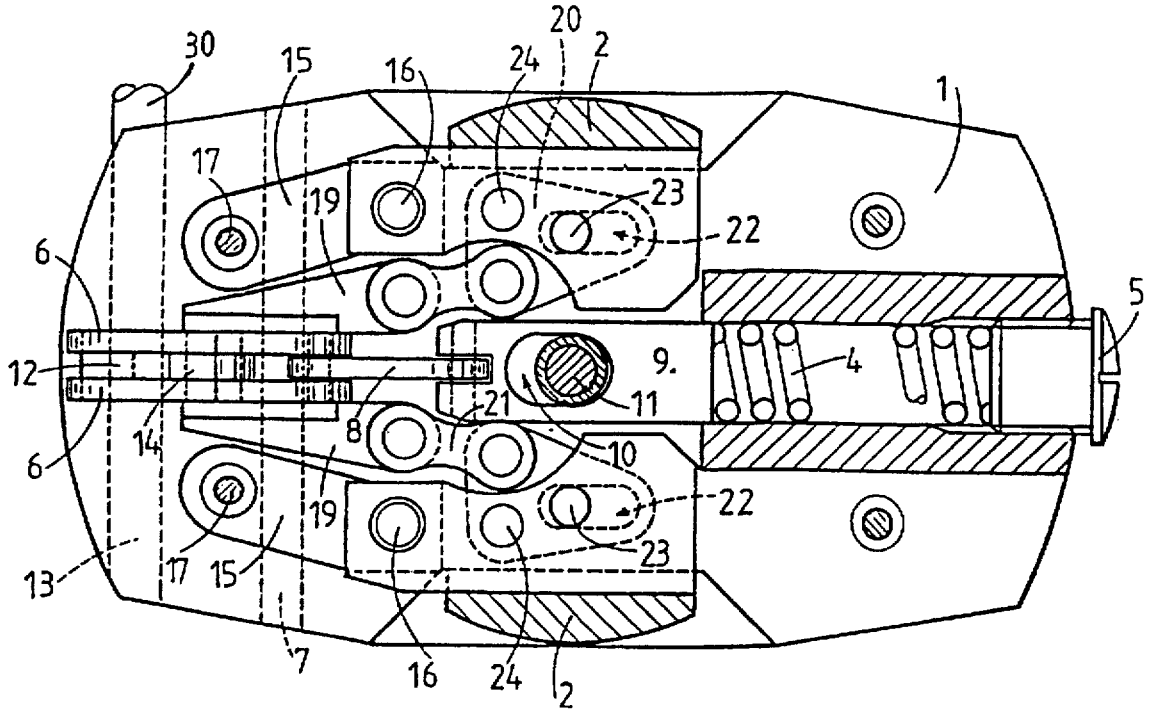
FIGS. 3 and 4 are views, partly in cross-section, taken horizontally and vertically, respectively, in the operative closed position.
Figure 4:
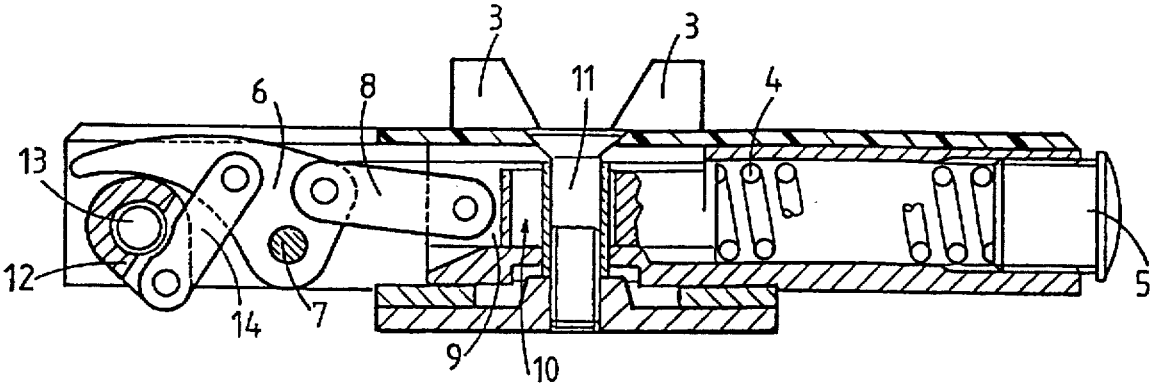
Figure 5:
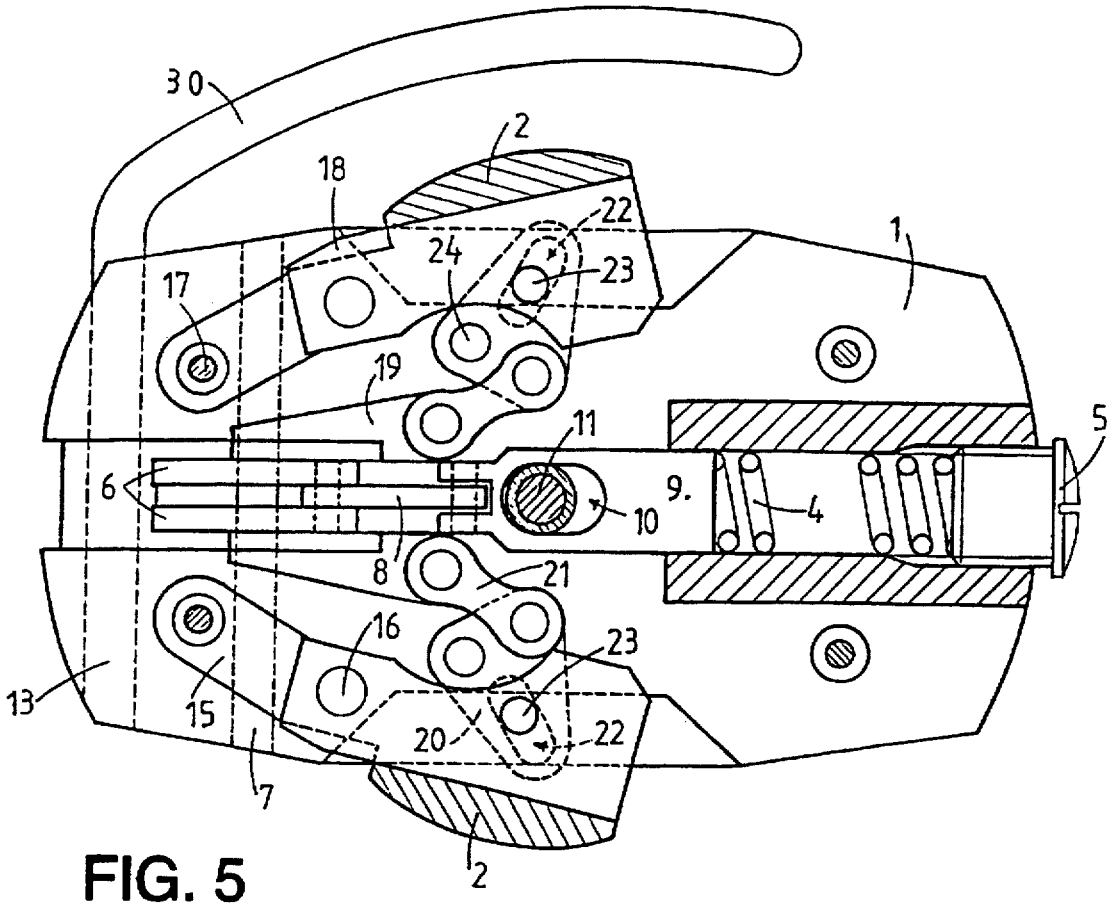
FIGS. 5 and 6 are views partly in cross-section, taken horizontally and vertically, respectively, in the non operative open position.
Figure 6:
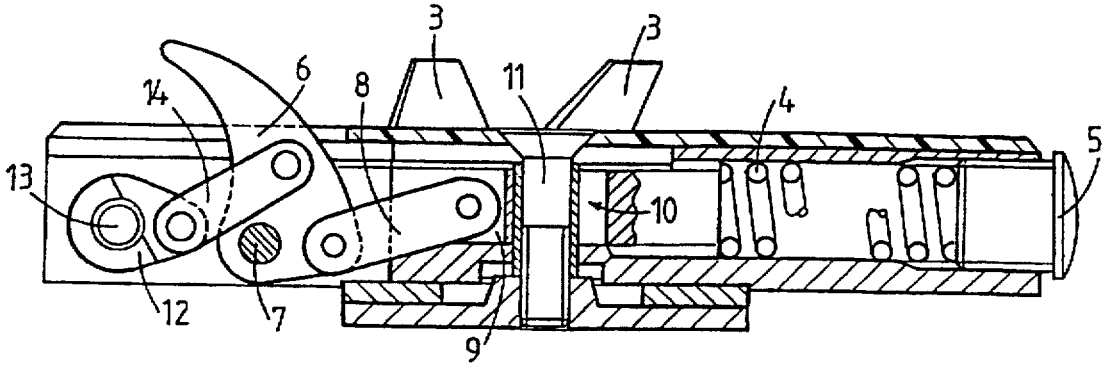

With reference firstly to FIGS. 1 and 2, the embodiment of the fastening device according to the invention illustrated by way of example includes a housing 1 designed for receiving the mechanism for fastening to the upper surface S of a snow surfboard and two lateral jaws 2 actuated by said mechanism and provided each one with prehensile claws or fingers 3; these claws 3 are designed for holding in the operative closed position a patterned or profiled section C which is integral with the sole of the shoe to be fastened (not illustrated), or is a portion attached beneath the shoe (see FIG. 2).

In practice, two fastening devices such as that illustrated in FIG. 1 are fastened to the snow board, running parallel to each other or not, and at an angle with respect to the longitudinal axis of said snow board which depends, in a manner known per se, on the requirements of the practice of this sport and on the choice made by the user. Means can also be provided between the housing 1 and the surface S of the snow board to allow an easy adjustment of the position of each one of the two fastening devices, in particular the above-mentioned angle.

In the open position (phantom lines), the lateral jaws 2 do not hold between them the profiled portion C of the sole of the shoe. The displacement between these two positions, respectively the closed one and the open one, is caused by the action of a resilient member 4 accumulating energy and located preferably in front of the jaws 2.

We shall describe now, with reference to FIGS. 3 to 6, the operating mechanism of the fastening device according to the invention designed for moving from the open position of the jaws (non operative position) to the closed one (operative position).

The action of the overall mechanism is brought about by a resilient member illustrated here as a spring 4 placed in front of the jaws 2 and the strength of which can be adjusted by an adjustment screw 5. This spring 4 acts on the lateral jaws 2 via a rocking system designed for defining two stable positions of the device, corresponding to the open and closed positions of the jaws 2, beyond a neutral point situated between these two positions. More particularly, a double engagement lever 6 is mounted pivotally on a horizontal transverse axis 7, fastened laterally, for example to the lateral walls of the housing 1. This engagement lever 6 acting as a rocking member is connected at the front via an axial linkage rod 8 to an axial bar 9 extending the resilient member 4. This bar 9 exhibits an axial guiding opening 10 cooperating with a fixed vertical axis 11, here a mounting screw for the device. On the other hand, the engagement lever 6 is connected at the back to an operating member 12 mounted pivotally on a horizontal transverse axis 13, fastened laterally, for example, in the lateral walls of the housing 1, via a straight linkage rod 14; the operating member 12 is in turn controlled by a hand lever 30 extending outwards from the transverse pivot axis 13.

On the other hand, each jaw 2 is hingedly connected to an arm 15 by means of a vertical journal 16, the free end of the arm 15 being mounted pivotally on a vertical journal 17 integral with the device, such that said jaw 2 may pivot in the horizontal plane. The linkage at 16 of the jaw 2 at the end of its support arm 15 is limited in its outward pivoting motion by a shoulder 18 which is provided on said jaw at its back end, this shoulder 18 abutting against said arm 15 upon the opening of the fastening device, after recovery of an operating step.

Finally, the mechanical link between the rocking member 6, which itself is controlled by the resilient member 4, is ensured by a double horizontal bar 19 cooperating in its axial translation motion with the double engagement lever 6 and connected to a triangular horizontal linkage member 20, via a linkage rod 21, this triangular linkage member 20 exhibiting an extended opening 22 with which cooperates a journal 23 integral with the jaw 2.

Thus, the backwards directed movement of translation of the device of bar 9, under the urging of the spring 4 for example, corresponds to an opening movement of the jaws 2. As mentioned already, the rocking member comprised of the engagement lever 6 makes it possible to define two stable positions for the mechanism, a first open position (non operative) corresponding to that illustrated in FIGS. 5 and 6 and a second closed or operative position corresponding to that of FIGS. 3 and 4. To move from one of the positions to the other (transition through the neutral point) against the bias of spring 4, one must operate the engagement lever 6 either directly or indirectly.

When the fastening device is in the open position (FIGS. 5 and 6), the engagement lever 6 acts as an automatic engagement means when the user steps into it and presses his shoe vertically downwards to bring it into position between the jaws 2, to pivot said lever around the axis 7 and bring the whole system of linkage rods into the closed operative position (FIGS. 3 and 4), the claws 3 of the jaws 2 then holding between them the profiled or patterned portion C of the shoe of the user.

To open the jaws 2 and thus release the portion C of the shoe, the user must actuate the hand lever 30 by pulling it upwards against the bias of the spring 4, to pivot the operating member 12 and thus bring the engagement lever 6 into its upper non operative position. This opening of the jaws can of course be brought about by the user falling down, by an impact or a torsion, when one such event causes a stress on the jaws 2 which is higher than that the predetermined bias of the resilient member 4; the device then acts as a safety device, which is a clear advantage over fastening devices presently known for snow boards.

The possibility of engaging automatically the fastening device when stepping into it is an innovation which offers a remarkable practical advantage, since the presently sold fastening devices for snow boards all require the intervention of the user, for example to close a bracket at the front of his shoe.

On the other hand, owing to the pivoting motion of the jaws brought about by a linkage arm, the claws 3 of these lateral jaws 2 remain permanently in contact with the corresponding pattern C of the sole of the shoe, even in the often unavoidable presence of a layer of snow, ice or even earth or small gravel, between this shoe sole and the upper plate of the fastening device, this undesirable thickness being in a way compensated by a slightly greater spreading range (a few mm) of the jaws 2 outwardly, made possible by the linkage thereof at 16 to the support arm 15, the linkage journals 16 being also biased apart outwardly and the jaws 2 then forming a slightly obtuse angle with said arm 15.

Finally, it should be noted that the principle of having lateral jaws provides numerous advantages, of which the most important ones are an increased safety of operation, since the shoe can become disengaged axially in the frontward and backward directions without hindrance and the fact that it is no longer necessary to carry out an adjustment of the fastening device when the board is used by another surfer having shoes of a different length. This advantage is particularly appreciated when the snow boards are to be rented.

As to the shoe, it suffices that its sole exhibits in its median section a pattern or a profile or other shapes matching those of the jaws and which can be grasped by the same, either integral with said sole or added thereto.

I claim:

1. A device for fastening a snow board to a shoe with a sole having a mounting member, the device comprising:

two jaws (2) that are movable parallel to a plane of a bottom of the device that is adapted to be affixed to the snow board and generally parallel to a lateral axis of the device, said two jaws being movable between two stable positions, namely a closed position in which said jaws are close together and an open position in which said jaws are laterally farther apart than in said closed position;

two articulating arms (15), each having a first end pivotally mounted on a respective first journal (17) that is in a fixed position relative to the bottom of the device and a second end pivotally mounted to a longitudinal end of a respective one of said jaws (2) on a respective second journal (16) that is movable relative to the bottom of the device;

linkage means for urging longitudinally middle portions of said jaws to move laterally, said linkage means linking said middle portions to a rocking member (6);

said rocking member (6) having two stable positions corresponding to said open and closed positions, a first stable position in which a protruding portion of said rocking member extends from said device when said jaws are in said open position, and a second stable position in which the protruding portion is depressed into the device when said jaws are in said closed position, the protruding portion being constructed and arranged to be depressed by the shoe when the mounting member is placed between said jaws to move said jaws to said closed position; and a resilient member (4) connected to said rocking member for biasing movement of said rocking member.

2. The device of claim 1, wherein said linkage means comprises a first link (21) and a second link (20), said first link pivotally linking said rocking member to said second link, said second link pivotally linking said first link to said middle portion of one of said jaws.

3. The device of claim 2, wherein said second link (20) is generally triangular with connections to said first link and the respective one of said jaws at two corners, and wherein a third corner of said triangular second link is pivotally connected to a third journal that is integral with said one jaw.

4. The device of claim 2, wherein the connection of said second link to said middle portion of said one jaw comprises a slot in said second link for slidable movement of a third journal integral with said one jaw.

5. The device of claim 1, wherein said resilient member is connected to said rocking member through a link (8) and a bar (9), said bar being connected to said resilient member.

6. The device of claim 5, wherein said bar is mounted longitudinally and has a longitudinally extended slot therethrough that cooperates with a pin extending generally perpendicular to the plane of the bottom of the device.

7. The device of claim 1, wherein each of said jaws further comprises a shoulder at a longitudinal end that abuts a respective one of said arms for limiting laterally outward movement of the respective one of said jaws.

8. The device of claim 1, further comprising a manually operated lever for moving said rocking member (6) between said first and second stable positions, said lever extending laterally through the device between said rocking member and the bottom of the device.

9. A device for fastening a snow board to a shoe, the device comprising:

two jaws that are movable generally parallel to a lateral axis of the device, said two jaws being movable between a closed position in which said jaws are close together and an open position in which said jaws are laterally farther apart than in said closed position, said two jaws being pivotable about a movable pivot point, said movable pivot being movable with respect to a fixed pivot point;

links connecting longitudinally middle portions of said jaws to a rocking member so as to urge said middle portions to move laterally when said rocking member is moved between a first position in which a protruding portion of said rocking member extends from said device and a second position in which the protruding portion is depressed into the device; and a resilient member (4) connected to said rocking member for biasing movement of said rocking member.

10. The device of claim 9, further comprising two articulating arms, each having a first end pivotally mounted on a respective first journal that is in a fixed position relative to a bottom of the device and a second end pivotally mounted to a longitudinal end of a respective one of said jaws on a respective second journal that is movable relative to the bottom of the device.

11. The device of claim 9, wherein said links comprise a first link and a second link, said first link movably linking said rocking member to said second link, said second link movably linking said first link to said middle portion of one of said jaws, said second link being generally triangular with connections to said first link and the respective one of said jaws at two corners, and wherein a third corner of said triangular second link has a slot therein for slidable movement of a third journal that is integral with said one jaw.

* * * * *